US006450685B1

(12) United States Patent
Scott

(10) Patent No.: US 6,450,685 B1
(45) Date of Patent: Sep. 17, 2002

(54) RESEALABLE METALIZED THERMAL BAG

(76) Inventor: Steven Michael Scott, 810 Saturn St., Suite 16, Jupiter, FL (US) 33477

( * ) Notice: Subject to any disclaimer, the term of this patent is extended or adjusted under 35 U.S.C. 154(b) by 0 days.

(21) Appl. No.: 09/844,683

(22) Filed: Apr. 27, 2001

(51) Int. Cl.[7] ..... B65D 33/16; B65D 30/08

(52) U.S. Cl. ..... 383/63; 383/104; 383/116; 383/110

(58) Field of Search ..... 383/63, 109, 104, 383/107, 116, 110

(56) References Cited

U.S. PATENT DOCUMENTS 3,827,472 A * 8/1974 Uramoto ..... 383/63 X
3,980,225 A * 9/1976 Kan ..... 383/63 X
4,252,238 A * 2/1981 Spiegelberg et al. ..... 383/63 X
4,848,928 A * 7/1989 Ausnit ..... 383/63 X
5,004,356 A * 4/1991 Matsui ..... 383/63
5,535,543 A 7/1996 Alexander
5,582,853 A 12/1996 Marnocha et al.
5,674,010 A 10/1997 Dussich
5,941,641 A 8/1999 Kinigakis et al.
6,007,245 A 12/1999 Looy
6,199,698 B1 * 3/2001 Hetrick et al. ..... 206/532

* cited by examiner

*Primary Examiner*—Jes F. Pascua
(74) *Attorney, Agent, or Firm*—McHale & Slavin

(57) ABSTRACT

A thin, lightweight, flexible bag for maintaining an initial inner temperature for an extended period of time has multilayered walls with a thermoplastic inner layer and a metalized outer layer. The mouth of the bag has a resealable closure.

5 Claims, 1 Drawing Sheet

RESEALABLE METALIZED THERMAL BAG

FIELD OF THE INVENTION

This invention relates to the field of flexible lightweight containers which provide a thermal barrier to maintain the initial temperature of the contents for an extended period of time. In the terminology of this application, the initial temperature of the contents refers to a temperature significantly above or below ambient temperature.

BACKGROUND OF THE INVENTION

Thermos bottles and their vacuum properties are old and well known in the food arts for maintaining a particular internal temperature for a long time. Because of the concentric tubes separated by a partial vacuum, these bottles are usually used for storing liquids.

Larger containers, usually referred to as, "coolers," are used to store solid foods and bulkier items. These devices rely on the thick walls with low thermal conductivity to provide a thermal barrier. The wall structure is foam material having low heat transmission index covered on both sides with a hard plastic or metal for rigidity and support. In general, the coolers are not as efficient as the vacuum bottle since there is a greater transfer of heat across the wall structure of the cooler. Both the vacuum bottle and the cooler have an enclosed space surrounded by rigid walls making them both cumbersome and heavy to transport.

There are flexible thermal pouches in the food arts. Probably, most well known are the pouches used to deliver pizza pies. These devices also depend on a thick wall structure to provide a barrier to separate the thermal difference between the inside of the pouch and the outside, ambient, temperature. The wall structure of the pouches is similar to the coolers without the hard shell for support. Because of the thickness of the wall structure, the pouches occupy a great deal of space for the size of the interior.

In addition to the thermal devices discussed above, the food arts include thin plastic storage bags which protect the contents from the outside atmosphere. There are several different closures used to temporarily or permanently seal the bags. One type of temporary closure has a flexible bead that may be forced into a flexible groove to form a seal.

However, what is needed in the food art is a thin flexible re-sealable bag that has the thermal properties of a much bulkier thermal pouch or cooler.

DESCRIPTION OF THE PRIOR ART

There are several patents that teach the use of thin plastic bags for storage of food items. Among the patents are U.S. Pat. No. 5,582,853 directed to a display bag having a polyester outer layer, U.S. Pat. No. 5,941,641 directed to a polyester plastic bag with particular features of bag construction, U.S. Pat. No. 5,535,543 directed to a plastic bag having thermo-protection, and U.S. Pat. No. 5,674,010 teaching a bendable material for closing the mouth of the bag.

There are other bags with thermal properties, such as U.S. Pat. No. 6,007,245 to a infrared cloaking bag, for use by a human to evade IR sensors. These bags, in the nature of a sleeping bag, are laminated structures of a polyester and a metalized coating.

SUMMARY OF THE INVENTION

A thin, lightweight, flexible bag for enclosing contents with an initial temperature and maintaining the initial temperature of the contents for an extended period of time. The flexible bag has metalized polymer walls having opposite end edges and opposite side edges. The opposite end edges and opposite side edges superimposed the opposite end edges and opposite side edges forming a periphery having four sides. The periphery being integrally closed on three sides, a mouth formed on the fourth side. The mouth having a re-sealable friction fit closing device having cooperating components fixed to the opposite end edges. One of the cooperating components being an elongated bead, another of component being a channel shaped receiver. Whereby the bead is resiliently engaged with the receiver to temporarily close the bag.

Accordingly, it is an objective of the instant invention to teach a thin flexible bag having thermal properties.

It is a further objective of the instant invention to teach a thin flexible bag having laminated wall structure which provides strength and has a low thermal transmission.

It is yet another objective of the instant invention to teach a bag having polymeric walls laminated with a metalized coating and a temporary seal for the mouth of the bag.

It is a still further objective of the invention teach a laminated bag construction which provides secure seams and a sealed mouth that maintains the initial temperature of the contents for an extended period of time.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE INVENTION

Figure 1:
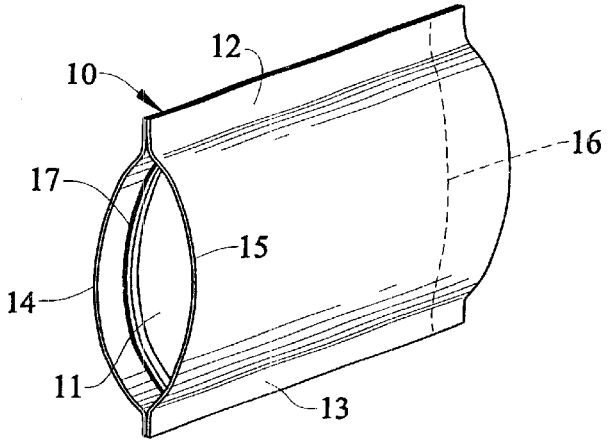
FIG. 1 is a perspective of the invention showing the edge seal and the mouth of the bag open.

In FIG. 1, the bag 10 is shown with the mouth 11 open from one edge seam 12 to the other edge seam 13. The bag is formed from a single multilayered sheet of material 1. The multilayered sheet has an inner layer 2, of approximately 50 microns, heat sealable polymer, such as polyethylene, adhesively bonded to an intermediate layer 3 of polyester or other non-thermoplastic polymer, and an outer metalized layer 4 deposited on the intermediate layer. The polyester with deposited metalized layer is approximately 12 microns. The integral multilayered sheet provides the flexibility, durability, and bonding capability of the thermoplastic film 2 together with the low thermal transmission and imperviousness of the metalized polyester 3 and 4. The metalized layer 4 may be aluminum or other low thermal index metal laminated to the polyester either by adhesive or by vapor deposit. The multilayered sheet is folded upon itself, to form opposite walls, and permanently sealed along the two opposite side edges forming side seals 12 and 13. The open mouth 11 is the unattached end edges 14 and 15 of the sheet 1 and the bottom of the bag is the integral fold 16. An alternative construction (not shown) utilizes two multilayered sheets of metalized polyester permanently sealed on three sides.

Figure 2:
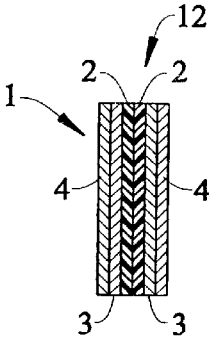
FIG. 2 is a cross section of the edge seal.

In FIG. 2, the side seals 12 and 13 are depicted. Both seals are identical. The side edges of the sheet material are superposed upon each other when the sheet is folded. The side seals 12 and 13 may be formed by several different procedures which result in an area seal. The seals do not destroy the integrity of the sheet material. The seals may be established by adhesion or cohesion or with heat and pressure, autologously or with additional adhesives, thermoplastic or otherwise. In the preferred embodiment, the inner thermoplastic layer is bonded to itself by heat and pressure. An area seal provides more intimate contact between the adjacent layers and less chance for discontinuities than a line seal.

Figure 3:
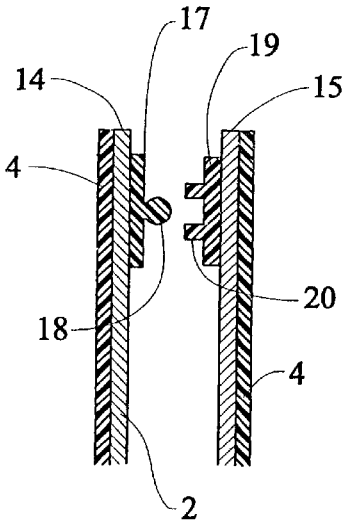
FIG. 3 is a cross section of the laminated wall and mouth closure.
Figure 4:
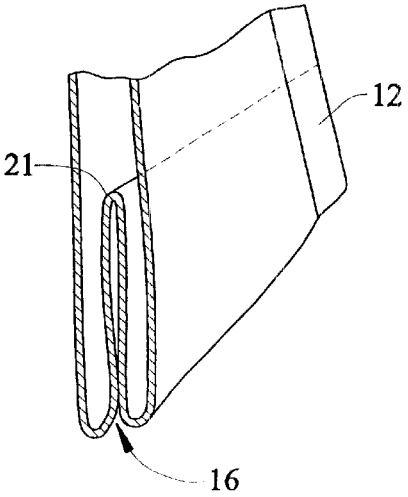
FIG. 4 shows the pleated bottom of the bag.

The mouth of the bag has cooperating seal structure for temporarily holding the mouth of the bag closed, as shown in FIG. 3. The seal structure is disposed in the interior of the bag and displaced inwardly from the end edges 14 and 15 of the mouth. A base strip 17 is affixed to the interior of end edge 14, as shown in FIG. 3. The base strip 17 extends from one side seal 12 to the other side seal 13 and carries a longitudinal sealing bead 18. End edge 15 has a base strip 19 affixed at a location opposite the base strip 17. The base strip 19 carries a longitudinal channel shaped receiver 20. The sealing bead 18 is slightly larger than the channel shaped receiver 20 and tightly fits into the channel shaped receiver 20 forming a temporary seal across the mouth of the bag. The friction fit between the receiver 20 and the bead 18 may be opened and closed, as desired, without damage to the components. When the bead is fitted into the receiver, the mouth of the bag is sealed to prevent entry of ambient air and temperature. In the preferred embodiment, the seal structure is made of thermoplastic polymer, such as polyethylene, and the strips 17 and 19 are heat sealed to the thermoplastic inner layer on opposite sides of the mouth of the bag. The initial temperature of contents within the sealed bag will be maintained for an extended period of time. The stand-up gusset 16, shown in FIG. 4, is in the form of a transverse pleat 21 to provide an excess of material allowing the bag to expand laterally to increase the interior volume without stressing the wall structure. The pleat 21 is formed from a double reverse fold that has four layers of sheet material juxtaposed to each other. To achieve side seals in the area of the gusset 16, a portion of the non-thermoplastic intermediate layer 3 is removed to prevent blocking of the thermoplastic seal.

A container of frozen water was placed in a bag of this invention. The bag and container were placed in a standard ambient temperature room (72F degrees). The total increase in temperature was determined over a 2 hour period to be approximately 15F degrees. In another test, a container of cold water was placed in a bag of this invention. The bag and container were placed in a room with a like container of unprotected water having the same initial temperature. The room temperature was approximately 77F degrees. The unprotected water increased in temperature at approximately twice (2×) the rate of increase of the initial temperature of the container of water in the bag.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A thin, lightweight, flexible bag for enclosing contents with an initial temperature and maintaining said initial temperature of said contents for an extended period of time comprising an integral multilayered film with a polyethylene inner layer approximately 50 microns thick bonded to an intermediate polyester layer and a metalized outer layer, said polyester layer and said metalized layer being approximately 12 microns thick, said bag having walls with opposite end edges and opposite side edges, said opposite end edges and said opposite side edges superimposed, said walls formed of said single integral multilayered film folded upon itself superposing opposite side edges and opposite end edges, said opposite side edges being permanently bonded together forming elongated side seals, one of said end edges folded upon itself in a double reverse fold to form an elongated pleat extending between said side seals, a mouth formed on the other of said end edges, said mouth having a re-sealable friction fit closing device, said closing device having cooperating components fixed to said opposite end edges, one of said cooperating components being an elongated bead, another of said components being a channel shaped receiver, whereby said bead is resiliently engaged with said receiver to temporarily close said bag.

2. A thin, lightweight, flexible bag of claim 1 wherein said double reverse fold elongated pleat is adapted to expand without exerting stress on said walls.

3. A thin, lightweight, flexible bag of claim 1 wherein said integral resealable closure has cooperating components extending from one opposite side seal to the other opposite side seal, one of said components being a thermoplastic strip carrying a bead, said other component being a thermoplastic strip carrying a channel shaped receiver, said thermoplastic strips bonded to said thermoplastic inner layer adjacent said mouth.

4. A thin, lightweight, flexible bag of claim 1 wherein said metalized layer is adhered to said polyester layer.

5. A thin, lightweight, flexible bag of claim 1 wherein said metalized layer is vapor deposited on said polyester layer.

* * * * *